US010619641B2

(12) United States Patent
Roessler et al.

(10) Patent No.: US 10,619,641 B2
(45) Date of Patent: Apr. 14, 2020

(54) ARRANGEMENT OF AN IMPELLER ON A ROTATING PART AND METHOD FOR PRODUCING THE ARRANGEMENT

(71) Applicant: Ziehl-Abegg SE, Künzelsau (DE)

(72) Inventors: Stefan Roessler, Rosengarten (DE); Michael Ruedenauer, Schöntal (DE)

(73) Assignee: Ziehl-Abegg SE, Kunzelsau (DE)

( * ) Notice: Subject to any disclaimer, the term of this patent is extended or adjusted under 35 U.S.C. 154(b) by 183 days.

(21) Appl. No.: 15/535,272

(22) PCT Filed: Dec. 1, 2015

(86) PCT No.: PCT/DE2015/200523

§ 371 (c)(1),
(2) Date: Jun. 12, 2017

(87) PCT Pub. No.: WO2016/091256

PCT Pub. Date: Jun. 16, 2016

(65) Prior Publication Data

US 2017/0321706 A1 Nov. 9, 2017

(30) Foreign Application Priority Data

Dec. 12, 2014 (DE) ..... 10 2014 225 688

(51) Int. Cl.
*F04D 25/06* (2006.01)
*F04D 29/26* (2006.01)
*F04D 29/64* (2006.01)

(52) U.S. Cl.
CPC ..... *F04D 25/0613* (2013.01); *F04D 29/263* (2013.01); *F04D 29/646* (2013.01)

(58) Field of Classification Search
CPC .... F04D 25/0613; F04D 25/08; F04D 29/263; F04D 29/329; F04D 29/646; F04D 29/703; F04D 29/706
See application file for complete search history.

(56) References Cited

U.S. PATENT DOCUMENTS 3,084,963 A * 4/1963 Beehler ..... F04D 29/263 403/226
3,302,867 A * 2/1967 Roffy ..... F04D 29/263 416/214 R (Continued)

FOREIGN PATENT DOCUMENTS

DE 202004010088 U1 9/2004
DE 202010011378 U1 11/2011
FR 2469610 A1 * 5/1981 ..... B29C 45/14311

OTHER PUBLICATIONS

International Search Report for PCT/DE2015/200523 dated Mar. 30, 2016.

*Primary Examiner* — Sizo B Vilakazi
*Assistant Examiner* — Anthony L Bacon
(74) *Attorney, Agent, or Firm* — McDonnell Boehnen Hulbert & Berghoff LLP

(57) ABSTRACT

An arrangement of an impeller (3) on a rotating part, preferably on an electric motor (1), in particular on an external rotor motor, wherein the torque of the motor (1) is transmitted to the impeller (3) by a rotationally secure connection between the rotor (2) of the motor (1) and the impeller (3) or its impeller hub (4), and wherein the connection is created by means of a press fit between the impeller hub (4) and the rotor (2), with integration of a sleeve (6) which is preferably securely assigned to the impeller hub (4) and which takes up mechanical stresses, is characterized in that the sleeve (6) is polygonal and is pressed onto the surface of the rotor (2), with at least minor deformation, forming axial contact surfaces. Also specified is a method for producing such an arrangement.

19 Claims, 6 Drawing Sheets

(56) References Cited

U.S. PATENT DOCUMENTS

Figure 1:
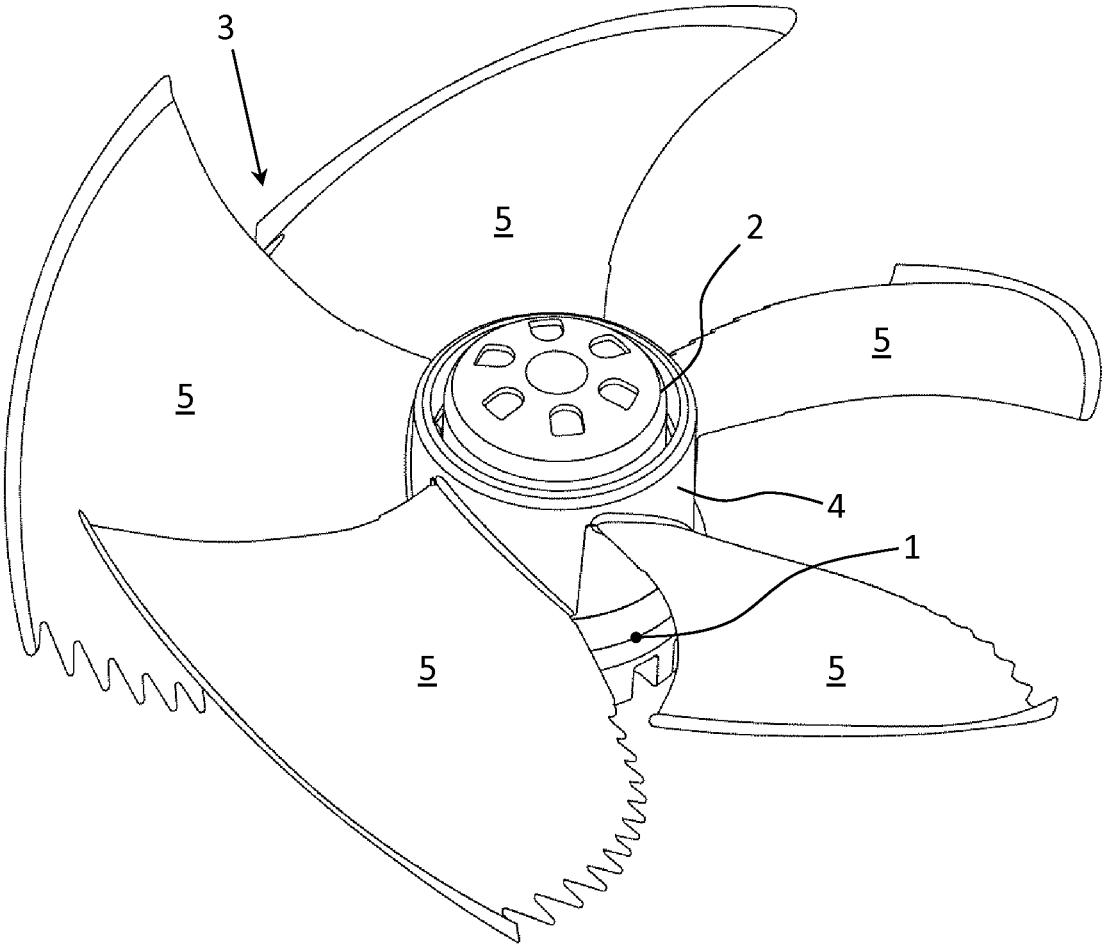

| | | | | |
|---|---|---|---|---|
| 5,871,335 | A * | 2/1999 | Bartlett | F04D 29/263 416/244 R |
| 6,073,593 | A * | 6/2000 | Nilson | F04D 25/022 123/41.12 |
| 2005/0012418 | A1 | 1/2005 | Chou et al. | |
| 2008/0063542 | A1* | 3/2008 | Oguma | F04D 25/0613 417/354 |
| 2009/0081044 | A1* | 3/2009 | Corcoran | F03B 11/00 416/204 A |
| 2012/0308416 | A1* | 12/2012 | Wu | H02K 21/227 417/423.1 |
| 2013/0280090 | A1* | 10/2013 | Sato | F04D 29/263 416/244 R |
| 2017/0175762 | A1* | 6/2017 | Aschermann | F04D 19/002 |

* cited by examiner

ARRANGEMENT OF AN IMPELLER ON A ROTATING PART AND METHOD FOR PRODUCING THE ARRANGEMENT

This application is a U.S. National Phase Application pursuant to 35 U.S.C. § 371 of International Application No. PCT/DE2015/200523 filed Dec. 1, 2015, which claims priority to German Patent Application No. 10 2014 225 688.7 filed Dec. 12, 2014. The entire disclosure contents of these applications are herewith incorporated by reference into the present application.

The invention relates to an impeller assembly on a rotating part, preferably on an external rotor motor. The rotating part can also be, e.g., a shaft formed in an internal rotor motor, or a hub or disk, e.g., in a belt drive. In any case, the term "rotating part" is to be understood in the broadest sense. For purposes of simplicity, reference shall be made in the following to an impeller assembly on an electric motor, in particular on an external rotor motor.

With the generic assembly, the torque of the motor is transferred to the impeller through a non-rotating connection between the rotor of the motor and the impeller, or its impeller hub. The connection is implemented via an interference fit (press fit) between the impeller hub and the rotor, with the integration of a round blank permanently dedicated to the impeller hub that mechanically absorbs tensions. Regarding the permanent dedication it should be noted that the impeller, or the impeller hub, and the round blank can be two independent parts, wherein a connection is formed when they are pressed together, or assembled. The invention also relates to a method for producing such an assembly.

The terms, "impeller" and "external rotor motor," or "external rotor" are to be understood in the broadest sense. In concrete terms, the impeller can be the fan wheel (axial impeller) of a ventilator, wherein the fan wheel is non-rotatably connected to the rotor (cf. DE 10 2011 015 784 A1). Instead of an axial impeller, the impeller can also be formed as a radial impeller and/or diagonal impeller.

Different methods are known in the field for attaching a fan wheel to the rotor of a motor.

Fan wheels made of aluminum can be produced, or cast, together with a rotor made of aluminum. The disadvantage here is that aluminum parts are normally expensive. Furthermore, they require a lot of finishing work, and particularly with regard to fan wheels, they cannot be used in a flexible manner. Specifically, it is not possible to implement different directions of air conveyance with identical components, specifically due to the fixed allocation of the components. Thus, two different combinations of aluminum parts must be available for the desired/necessary directions of air conveyance.

It is already known in the field to screw the fan wheel made of aluminum or plastic to the rotor of a motor. In this manner, both conveyance directions can be implemented, depending on how the fan wheel is screwed on. The fan wheel that is screwed on in this manner thus provides greater flexibility than the variation specified above. Furthermore, when a fan wheel made of plastic is used, the finishing work is significantly reduced in comparison with the parts made of aluminum, and the plastic fan wheel can be produced less expensively than a fan wheel made of aluminum. A not insignificant disadvantage thereby is that the screwing on of the fan wheel requires more time, however, thus increasing assembly costs.

In a third variation, the fan wheel is pressed onto the rotor, having the same flexibility as the screwed on fan wheel, such that both conveyance directions can be implemented with the same components. The assembly is simpler than with the screw variation, and thus cost-effective. With the implementation of a press fit, a round blank made of steel is used to establish a secure connection between the impeller, or the hub, and the rotor, normally produced in a progressive die, and placed in the impeller die prior to the injection molding procedure.

Condensation can form between the rotor and the impeller (e.g. a fan wheel), which is difficult to remove due to the given geometries. This is the case in particular when there are no free passages between the rotor and the hub of the impeller pressed thereon. This problem has already been acknowledged in the prior art, and grooves have been formed in the surface of the hub, weakening the mechanical properties of the hub, however, and also resulting in high tensions when the hub has been pressed on.

A rotor having a deep-drawn steel plate housing is frequently used, particularly in order to reduce costs, the surface of which is provided with a powder coating. As a result of the deep-drawing and the application of the powder coating, a large tolerance zone must be bridged.

Accordingly, the sheet metal round blank used with the impeller must have a smaller diameter than the rotor, in order to form a secure connection, even in a "worst case scenario." Steps to ensure a certain level of security must be implemented in any case. The difference in diameters that is to be bridged can be, e.g., 0.6 to 0.8 mm. Calculations according to the finite element method (FEM) have shown that the expansion of the diameter is transferred to the plastic hub. If an expansion of 0.6 mm in the diameter is applied to the sheet metal round blank, and thus the hub, then in certain circumstances, the hub is very close to the breaking limits of the plastic material.

The aforementioned problems have already been acknowledged in the published prior art, e.g. in EP 1 609 996 B1. It has already been discussed therein that the cylindrical sheet metal round blank, as used in known plastic impellers, expands when it is pressed on. Because the plastic hub bears with the entire surface of the round blank on the rotor, an expansion of the round blank is transferred to the hub, such that, disadvantageously, high mechanical tensions may form in the hub, which is some cases can even result in the wheel breaking. A further disadvantage is that it is not possible to drain off condensation, which can form in the hub when the temperature falls below the dew point. Moreover, the plastic hubs inhibit heat transfer via the rotor surface.

In order to eliminate the disadvantages acknowledged in the prior art, it has been proposed in EP 1 609 996 B1 that a segmented metallic round blank be proposed, wherein the different segments of the round blank, each being a cylindrical part of the round blank, have different inner diameters. In other words, the round blank proposed in the prior art has curved surface segments having smaller inner diameters distributed evenly along the circumference of the round blank, such that the round blank only bears fully on the surface of the rotor with those segments having the smaller inner diameters.

The solution to the problem proposed in the prior art is, however, equally disadvantageous, because when the impeller is slid on, surface contacts exist from the start, and space is only obtained in the recessed regions formed therebetween having a small radius. The pressing on procedure still requires the application of force, and is difficult, and there is the risk that, due to the size of the segments of the round blank intended for contact, they bear on the surface of the rotor over the entire circumference when it has been pressed on, such that the same problem arises that existed before.

The present invention thus addresses the object of redesigning and developing the generic impeller assembly on an electric motor, such that the problems occurring in the prior art are at least substantially eliminated. A secure retention of the impeller on the rotor should be ensured, wherein the pressing of the impeller onto the rotor should be simple and quick. When the impeller has been pressed on, sufficient cool air should be able to pass over the rotor, and condensation drainage should be ensured. Furthermore, it should be ensured that the impeller is securely seated on the rotor during all of the loads arising during operation. Moreover, a method for producing such an assembly is to be provided.

The above objective is achieved through the features of claim 1. The generic assembly is thus characterized in that the round blank is polygonal, and is pressed onto the rotor, forming axial surface contacts with the surface of the rotor, such that it is at least slightly deformed.

According to the invention, it has been acknowledged that a simple and secure connection can be produced between the impeller and the rotor, through the integration of a round blank, when the round blank is polygonal. If the round blank, with an imaginary, inscribed inner circle, has an inner diameter equal to the outer diameter of the rotor, then the round blank forms an axial linear contact with the surface of the rotor, having a number of lines corresponding to the number of surfaces existing between the corners, which bear with their respective smallest inner diameter on the rotor surface in a linear manner. When the round blank becomes deformed when it is slid onto the rotor, the linear contacts expand to form axially oriented surface contacts, wherein space remains for draining condensation and for air circulation for cooling purposes.

Fundamentally, the round blank can be made of any arbitrary materials, with the prerequisite that it ensures sufficient mechanical stability in or on the hub of the impeller. It is also conceivable that the round blank is generated in situ during the production of the impeller or impeller hub, defined, for example, by a region made of more stable material.

In a particularly advantageous manner, the round blank is designed as a metal round blank, wherein this round blank can be made, in particular, of sheet metal, preferably steel sheet metal. In this manner, it is ensured that the round blank is sufficiently stable.

As stated above, the round blank is a polygonal component. It should be noted at this point that, in particular with respect to the prior art, the term "round blank" shall be retained, even though this is not ideally a round component according to the teachings claimed herein. Instead, this is a polygonal component, e.g. a round blank having eight corners, resulting in a round blank having eight surfaces between the eight corners, having a corresponding eight contact lines, or axially expanded contact surfaces. The number of preferred, or even necessary, corners depends substantially on the diameter of the rotor and the necessary gap between the rotor and the round blank. The octagonal design of the round blank is specified, by way of example, for a diameter in the range of 70 to 110 mm. With smaller diameters, the round blank can have three corners, and with larger diameters, it can have 16 corners.

In concrete terms, the sheet metal round blank can be injection molded on the interior surface of the hub, in the passage through the hub, into the material of the hub. In the framework of the injection molding production of the impeller or the hub, the round blank must be inserted into the injection mold. It is also conceivable that the hub is at least partially coated, and is securely joined to the impeller through the coating. It is not absolutely necessary that the round blank be entirely coated. When it is not entirely coated, gaps are formed between the round blank and the impeller hub. These gaps result in there being no continuous contact between the round blank and the hub after the round blank has been pressed on and deformed, such that no, or only slight, tensions are induced in the hub or the impeller. The round blank is advantageously only coated at those locations where it is not deformed, or experiences only very slight deformation.

The inner diameter of the round blank, or the circle inscribed in the polygonal round blank is smaller than the outer diameter of the rotor. Because of this measure, it is possible to press the round blank onto the rotor, wherein the surfaces between the corners become deformed when it is pressed on, forming the contact surfaces referred to above.

In concrete terms, the inner diameter of the round blank can be selected such that when the round blank is slid on, an initial axial linear contact is expanded to form an axial surface segment, or surface contact. The important thing is that a sufficient passage remains in the corner regions, in order to ensure, on one hand, ventilation along the surface of the rotor, and on the other hand, to ensure drainage of condensation. After the round blank has been pressed on and deformed, regions remain that are not in contact with the surface of the rotor.

The round blank can have structural measures that facilitate the sliding or pressing of the impeller onto the rotor. It is advantageous thereby, when the round blank has a circumferential flaring in the edge region, at least on one side, in order to facilitate the sliding or pressing thereof onto the rotor. If such an edge region is formed on both sides of the round blank, then the use of same impeller or fan wheel for both air conveyance directions is improved by the ease with which it can be slid or pressed on from both sides.

The method according to the invention achieves the object specified in the introduction through the features of claim 10. The method relates to the production of an assembly according to the invention, corresponding to the explanations above.

First, a motor is provided, wherein this motor can be an electric motor, in particular an external rotor motor. This is preferably supported vertically by a workpiece mount, such that the installation of the impeller or fan wheel takes place while the motor is held in a fixed position.

Furthermore, an impeller or fan wheel is provided for installation, wherein this impeller comprises a polygonal round blank corresponding to the assembly according to the invention. The round blank is integrated in the passage of the impeller, such that it serves to attach the impeller to the rotor.

In accordance with the desired conveyance direction of the medium, the impeller is positioned in relation to the motor such that the same impeller can be used for both conveyance directions. The impeller is then slid onto the rotor and pressed thereon, deforming the round blank such that axial, segmented surface contacts exist in relation to the surface of the rotor, having open passages between them through which fluids—air and/or water—can flow.

As a result, according to the invention, a sufficiently satisfactory connection is obtained between the surface of the rotor and the impeller, with reduced mechanical tensions. As a result of the axial passages existing in the corners of the round blank, condensation formed when the temperature falls below the dew point can be drained, without having to provide the hub with the otherwise necessary grooves. The passages also serve to conduct cooling air over the rotor surface, in order to dissipate heat.

Figure 2:
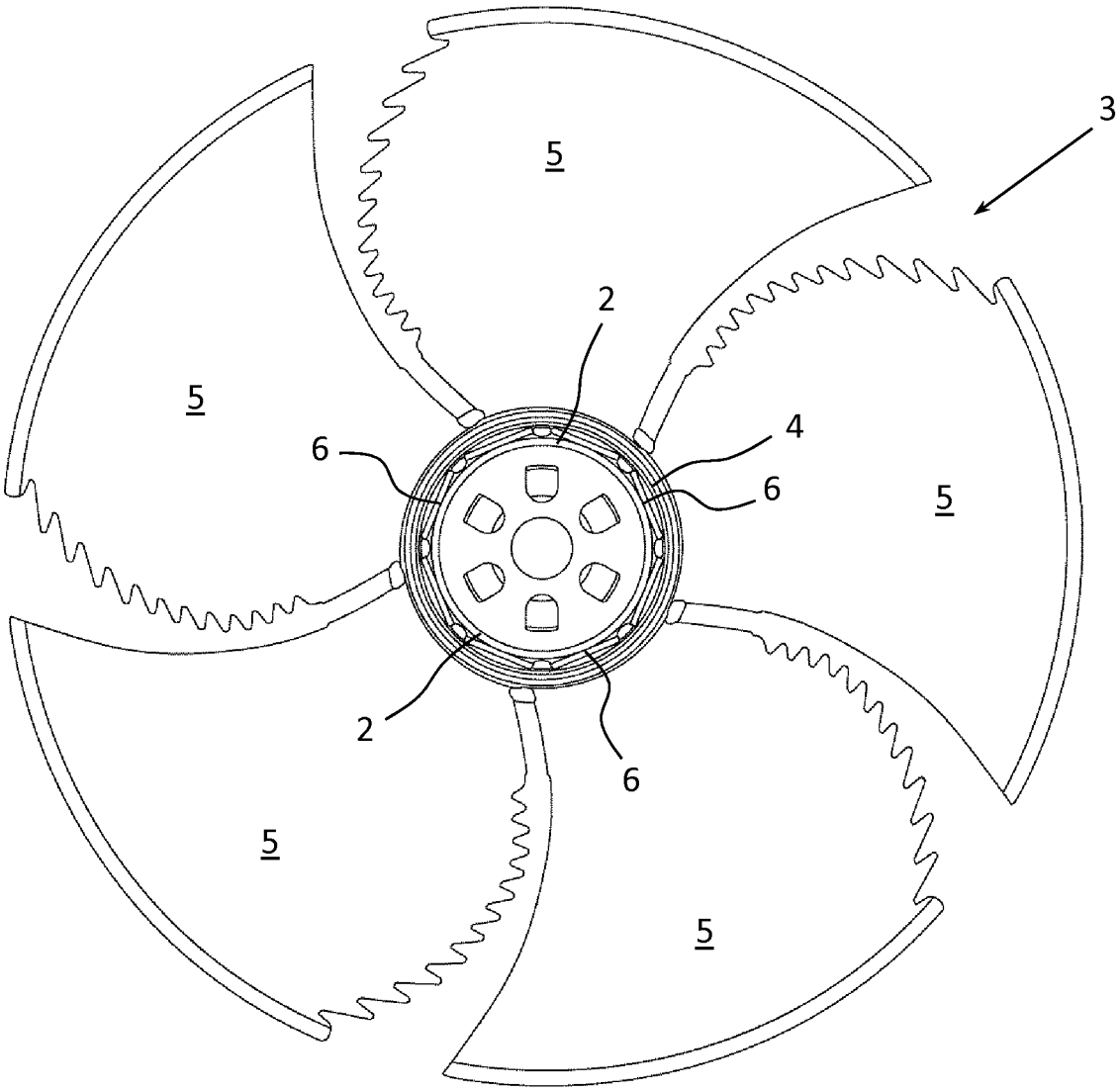
Figure 3:
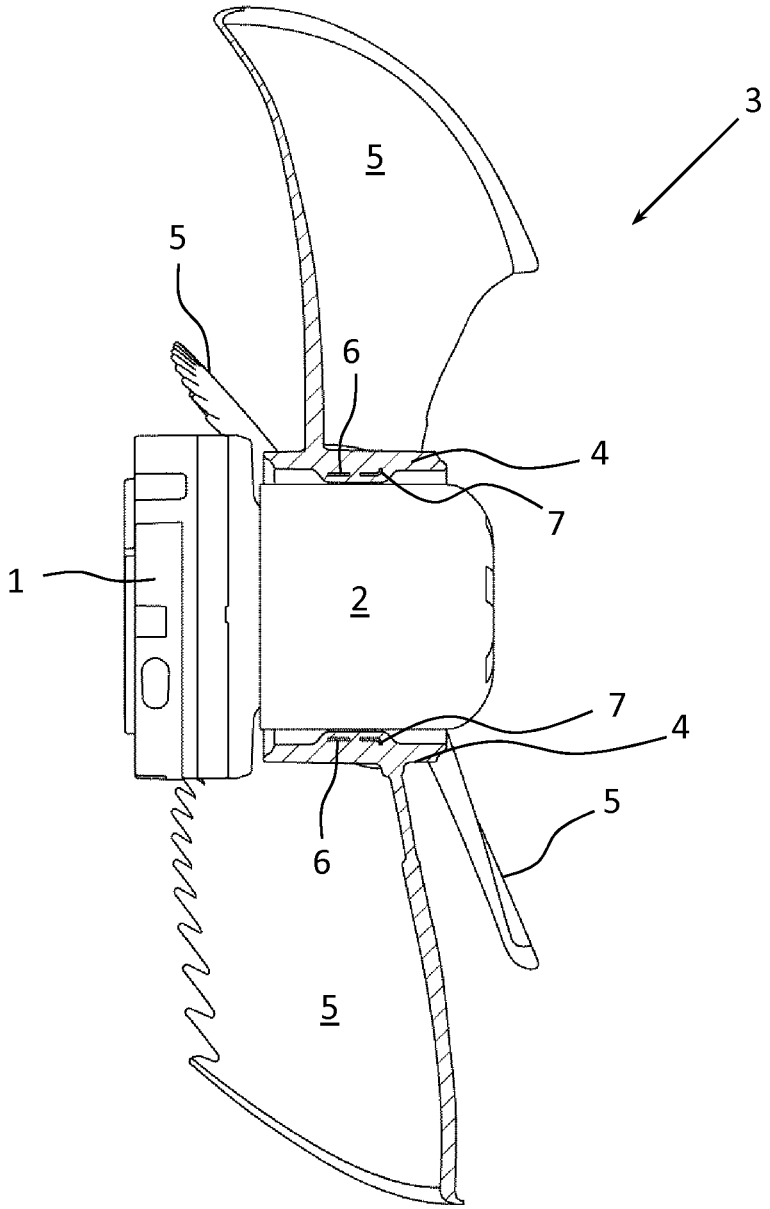
Figure 4:
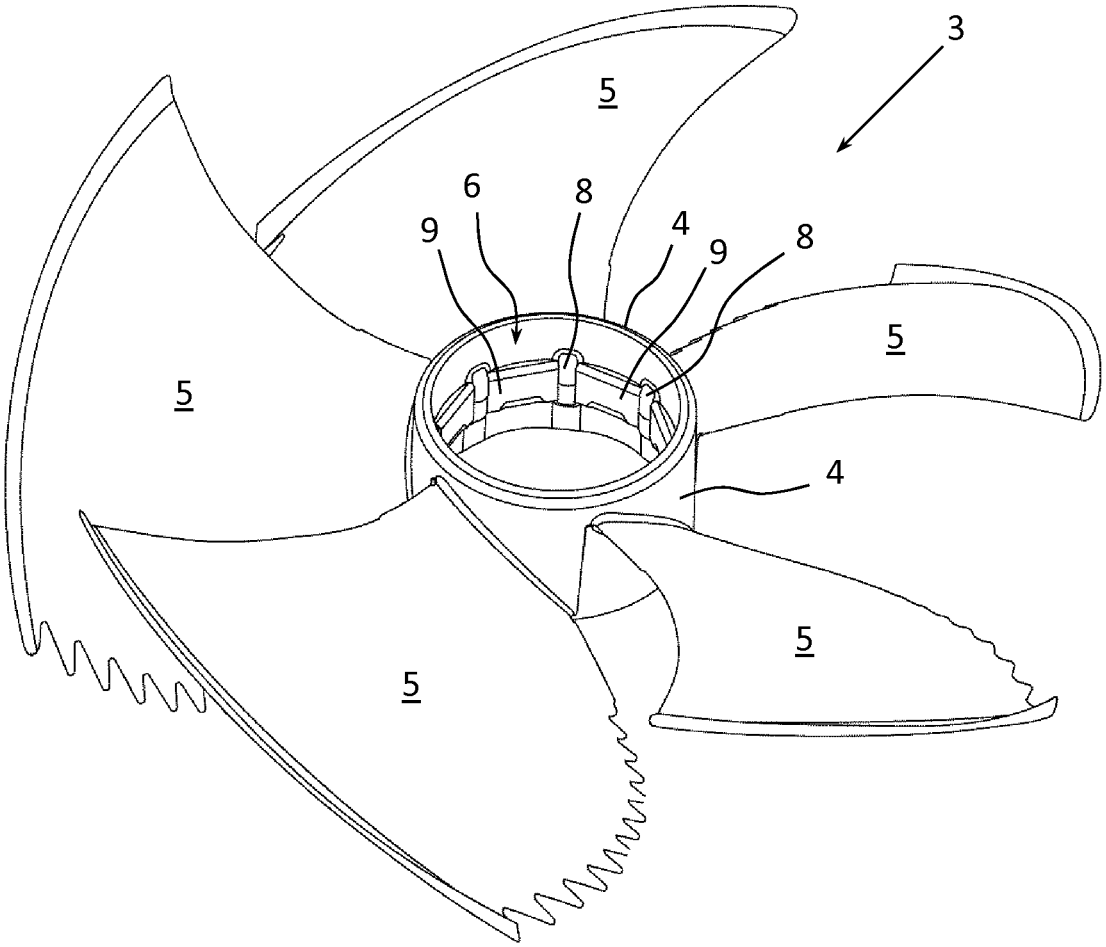
Figure 5:
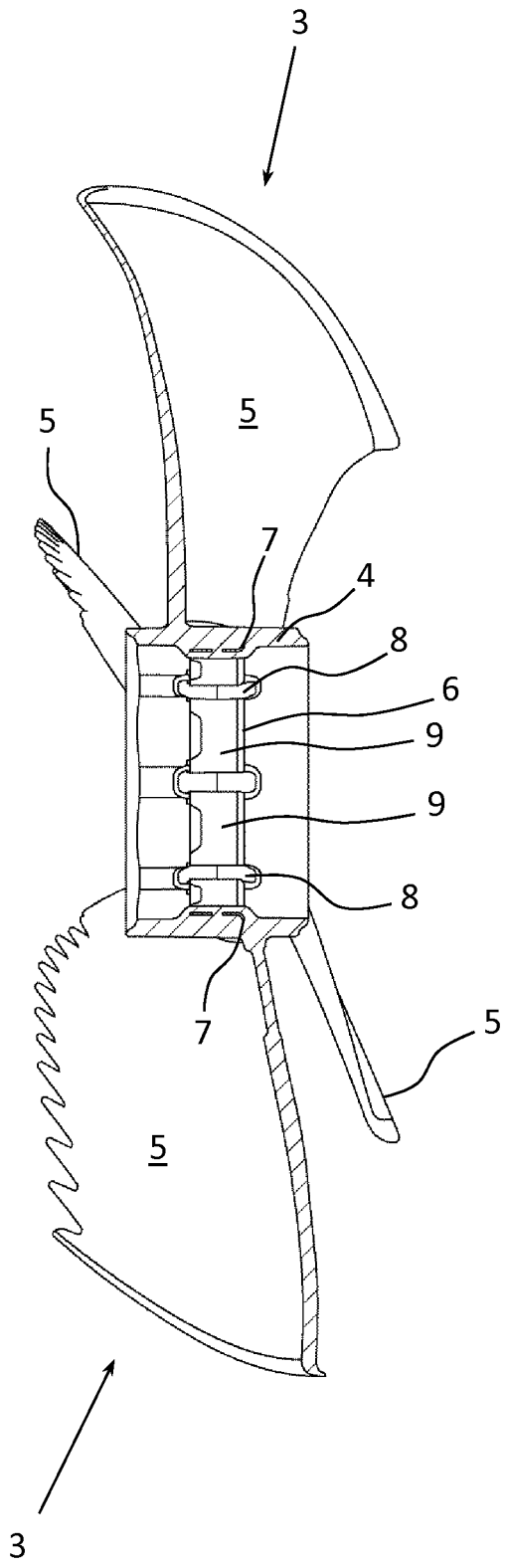
Figure 6:
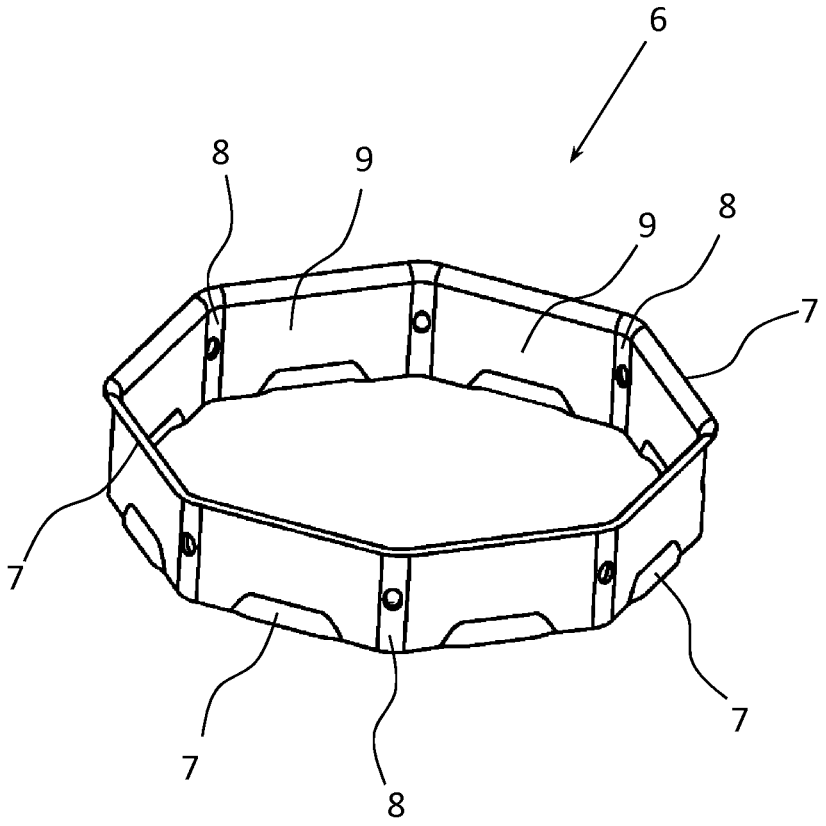

There are now various possibilities to advantageously embody and develop the teachings of the present invention. For this, reference is made, on one hand, to the Claims subordinate to Claim 1, and on the other hand, to the following explanation of a preferred exemplary embodiment of the invention based on the drawings. In conjunction with the explanation of the preferred exemplary embodiment of the invention based on the drawings, preferred designs and developments of the teachings are explained in general. Therein:

FIG. 1 shows a schematic view of an exemplary embodiment of an assembly according to the invention, in concrete terms, an axial ventilator, in the assembled state, FIG. 2 shows the subject matter of FIG. 1 in a schematic front view, FIG. 3 shows the subject matter of FIGS. 1 and 2, in a partial cutaway, in a schematic side view, FIG. 4 shows, in a schematic view like that in FIG. 1, the impeller of the subject matter of FIGS. 1 to 3, without a rotor, FIG. 5 shows the impeller from FIG. 4, in a view like that in FIG. 3, but without a rotor, and FIG. 6 shows a schematic view of an exemplary embodiment of a sheet metal round blank, corresponding to the design used in the impeller according to FIGS. 1 to 5.

FIG. 1 shows an assembly according to the invention in a schematic view, comprising an electric motor 1 with a rotor 2, wherein an impeller, hereinafter referred to as a fan wheel 3, is pressed onto the rotor 2. A non-rotating connection between the hub 4 of the fan wheel 3 and the rotor 2, or its surface, is produced by a press fit.

The blades 5 are provided with aerodynamic features, which do not play a role with respect to the teachings according to the invention.

It should be noted at this point that the fan wheel 3 is pressed onto the rotor 2 in order to generate a concrete flow direction. For the reverse flow direction it is possible to press the fan wheel 3 onto the rotor facing in the other direction, without changing the type and design of the fan wheel 3.

FIG. 2 shows the subject matter in FIG. 1 in a top view, wherein the polygonal round blank 6 can be seen in a schematic view, between the hub 4 of the fan wheel 3 and the rotor 2, the surfaces of which are in contact with the surface of the rotor 2, which can be referred to as a widened linear contact. Ultimately, this concerns axially extending segmented contact surfaces, which are more or less pronounced, depending on the deformation of the round blank 6.

FIG. 3 shows the subject matter in FIGS. 1 and 2 in a schematic side view, with a partial cutaway. FIG. 3 clearly shows that the round blank 6 is designed as a sheet metal round blank in the exemplary embodiment selected herein, which is integrated into the material of the hub 4 of the fan wheel 3. The round blank 6 is coated with the same material as the fan wheel, e.g. plastic.

FIG. 3 also indicates that the round blank 6 has a flared region 7 on one side. Regardless thereof, the fan wheel 3 having the round blank 6 molded therein, is designed such that the fan wheel 3 can be pressed automatically onto the rotor 2 for both conveyance directions. A single fan wheel is to be provided for both conveyance directions, resulting in a significant reduction in storage costs. This results in a maximum of flexibility.

FIG. 4 shows the fan wheel 3 of the assembly from FIGS. 1 to 3, without a rotor. The hub 4 of the fan wheel 3 is provided in the interior with the round blank 6, having an octagonal design. When it has not been slid on, i.e. according to the depiction from FIG. 4, the planar surfaces 9 extending between the corners 8 of the round blank 6 have a common smallest radius, formed by the respective central contact points of these surfaces 9 with an inscribed circle. This radius must be smaller than the outer diameter of the rotor 2 with respect to the surface of the rotor 2, in order to enable a pressing of the hub 4 with the integrated round blank 6 onto the rotor, while deforming the round blank 6, more precisely, while deforming the originally planar surfaces 9 extending between the corners 8.

It should be noted with regard to the round blank 6, that it can exhibit arbitrary measures, such as embossing or beading, etc. in order to improve the stability/rigidity, without abandoning the teachings of the invention thereby.

FIG. 5 shows the subject matter in FIG. 4, in an illustration corresponding to FIG. 3, but without a motor 1/rotor 2. Here as well, the integrated round blank 6 can be discerned with its corners 8 and surfaces 9.

Lastly, FIG. 6 shows the round blank 6 alone, as an octagon in this exemplary embodiment, with surfaces 9 lying therebetween, which serve as bearing surfaces on the rotor 2, and become deformed when the hub 4 or the fan wheel 3 is pressed onto the rotor 2, resulting in the mechanical purchase when subjected to a corresponding tension.

FIG. 6 also shows a circumferential flared region 7, which facilitates the sliding and pressing thereof onto the rotor 2 in one direction. Discrete flarings 7 are provided on the opposite side of the round blank 6 in a segmented design, which facilitate the sliding or pressing on, facing in the other direction. Each of the two edge regions can have either a circumferential flaring 7, or individual discrete flarings 7.

Regarding further advantageous embodiments of the teachings according to the invention, reference is made to the general description and to the attached Claims, in order to avoid repetition.

Lastly, it is expressly stated that the exemplary embodiment described above serves only as a means for explaining the claimed teachings, while these teachings are not limited to the exemplary embodiment.

LIST OF REFERENCE SYMBOLS

1 electric motor
2 rotor
3 impeller, fan wheel
4 hub, impeller hub
5 blade
6 round blank
7 expanded edge region (edge region of the round blank), flaring
8 corner of the round blank
9 planar surface of the round blank

The invention claimed is:

1. An impeller assembly on a rotating part of motor, wherein the torque of the motor (1) is transferred to the impeller (3) by a non-rotating connection between the rotor (2) of the motor (1) and the impeller (3), or its impeller hub (4), and wherein the connection is implemented via a press fit between the impeller hub (4) and the rotor (2), incorporating a round blank (6) that absorbs mechanical tensions, characterized in that the round blank (6) is polygonal and has planar surfaces (9) between corners (8), wherein the round blank (6) is pressed onto the rotor (2) such that the planar surfaces (9) extending between the corners (8) form at least slightly deformed axial contact surfaces in contact with the surface of the rotor (2).

2. The assembly according to claim 1, characterized in that the round blank (6) is generated in situ during the production of the impeller (3) or the impeller hub (4).

3. The assembly according to claim 1, characterized in that the round blank (6) is a metal round blank.

4. The assembly according to claim 1, characterized in that the round blank (6) is octagonal.

5. The assembly according to claim 1, characterized in that the inner diameter of the round blank (6) is smaller than the outer diameter of the rotor (2).

6. The assembly according to claim 5, characterized in that the inner diameter of the round blank (6) is selected such that when the round blank (6) is slid on, an initial axial linear contact is expanded to form an axial surface contact.

7. The assembly according to claim 5, characterized in that the inner diameter of the round blank (6) is selected such that after the round blank (6) has been pressed on and deformed, regions remain that are not in contact with the surface of the rotor (2).

8. The assembly according to claims 1, characterized in that the round blank (6) has a zonal or segmented, or circumferential flaring in the edge region (7), in order to facilitate the sliding and pressing onto the rotor (2).

9. The assembly according to claim 1, characterized in that the motor is an electric motor.

10. The assembly according to claim 1, characterized in that the motor is an external rotor motor.

11. The assembly according to claim 1, characterized in that the round blank is permanently dedicated to the impeller hub.

12. The assembly according to claim 3, characterized in that the round blank is made of sheet metal.

13. The assembly according to claim 12, characterized in that the round blank is molded on the inside of the hub, in its passage, into the material of the hub, or is at least partially coated.

14. The assembly according to claim 3, characterized in that the round blank is made of steel sheet metal.

15. The assembly according to claim 6, characterized in that the inner diameter of the round blank is selected such that after the round blank has been pressed on and deformed, regions remain that are not in contact with the surface of the rotor.

16. A method for the production of an assembly comprising:

providing a motor (1);

providing of an impeller (3) having a polygonal round blank (6), integrated in the passage of the impeller (3);

positioning of the impeller (3) in accordance with the desired conveyance direction with respect to the motor (1); and sliding of the impeller (3) onto the rotor (2) while deforming planar surfaces (9) between corners (8) of the polygonal round blank (6) such that axial, segmented surface contacts are formed in relation to the surface of the rotor (2), with open passage areas lying between them, wherein the round blank (6) is pressed onto the rotor (2) such that the planar surfaces (9) extending between the corners (8) form at least slightly deformed axial contact surfaces with the surface of the rotor (2).

17. The method according to claim 16, characterized in that during the production of the impeller (3), a round blank (6) is selected with an inner diameter, having a size such that when the round blank (6) is pressed on, an initial axial linear contact expands to form an axial surface contact, such that after the round blank (6) has been pressed on and deformed, regions remain between the contact surfaces that are not in contact with the surface of the rotor (2).

18. The method according to claim 16, characterized in that the motor is an external rotor motor.

19. The method according to claim 16, characterized in that the motor is retained vertically by a workpiece mount.

* * * * *